US012630892B2

(12) United States Patent
Hage et al.

(10) Patent No.: US 12,630,892 B2
(45) Date of Patent: May 19, 2026

(54) METHOD OF INTRODUCING A METALLIFEROUS FEED IN AN IRONMAKING PROCESS

(71) Applicant: TATA STEEL IJMUIDEN B.V., Velsen-Noord (NL)

(72) Inventors: Johannes Leendert Teunis Hage, Bilthoven (NL); Hai Thong Ho, Amsterdam (NL); Frederic Adrien Blaffart, Liège (BE); Xuan Wang, Kessel-Lo (BE)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 788 days.

(21) Appl. No.: 17/641,464

(22) PCT Filed: Sep. 10, 2020

(86) PCT No.: PCT/EP2020/075362
§ 371 (c)(1),
(2) Date: Mar. 9, 2022

(87) PCT Pub. No.: WO2021/048297
PCT Pub. Date: Mar. 18, 2021

(65) Prior Publication Data

US 2022/0316017 A1 Oct. 6, 2022

(30) Foreign Application Priority Data

Sep. 12, 2019 (EP) ..... 19196881

(51) Int. Cl.
*C21B 13/00* (2006.01)
*C21B 13/14* (2006.01)
*C22B 1/245* (2006.01)

(52) U.S. Cl.
CPC ..... *C21B 13/0086* (2013.01); *C21B 13/0013* (2013.01); *C21B 13/008* (2013.01); *C21B 13/143* (2013.01); *C22B 1/245* (2013.01)

(58) Field of Classification Search
None
See application file for complete search history.

(56) References Cited

U.S. PATENT DOCUMENTS 3,832,158 A * 8/1974 Obenchain ..... C21B 13/002 75/499
2016/0024611 A1* 1/2016 Cho ..... C22B 1/16 75/436

FOREIGN PATENT DOCUMENTS

EP 0726326 A2 8/1996
EP 3220083 A1 9/2017
(Continued)

OTHER PUBLICATIONS

International Search Report and Written Opinion mailed Nov. 10, 2020 to Tata Steel Ijmuiden B.V. for PCT/EP2020/076011 filed Sep. 10, 2020.

*Primary Examiner* — Sally A Merkling
*Assistant Examiner* — Sean P. O'Keefe
(74) *Attorney, Agent, or Firm* — Vorys, Sater, Seymour and Pease LLP; Maryellen Feehery Hank; Anthony P. Venturino

(57) ABSTRACT

A method of introducing a metalliferous feed in an ironmaking process, the method including the steps of, pre-drying an iron containing sludge by drying means to an amount of 15 to 30% (w/w) moisture, mixing the pre-dried iron containing sludge with a binder material to obtain a granulate, having a particle size of less than 4 millimeter and drying the granulate to a maximum of 3% (w/w) moisture, thereby forming the metalliferous feed, wherein the metal-
(Continued)

liferous feed is subsequently injected into a cyclone part of a metallurgical vessel.

3 Claims, 1 Drawing Sheet

(56) References Cited

FOREIGN PATENT DOCUMENTS

| | | | |
|---|---|---|---|
| WO | 9717307 | A2 | 5/1997 |
| WO | 2012126055 | A1 | 9/2012 |
| WO | 2013182377 | A1 | 12/2013 |

* cited by examiner

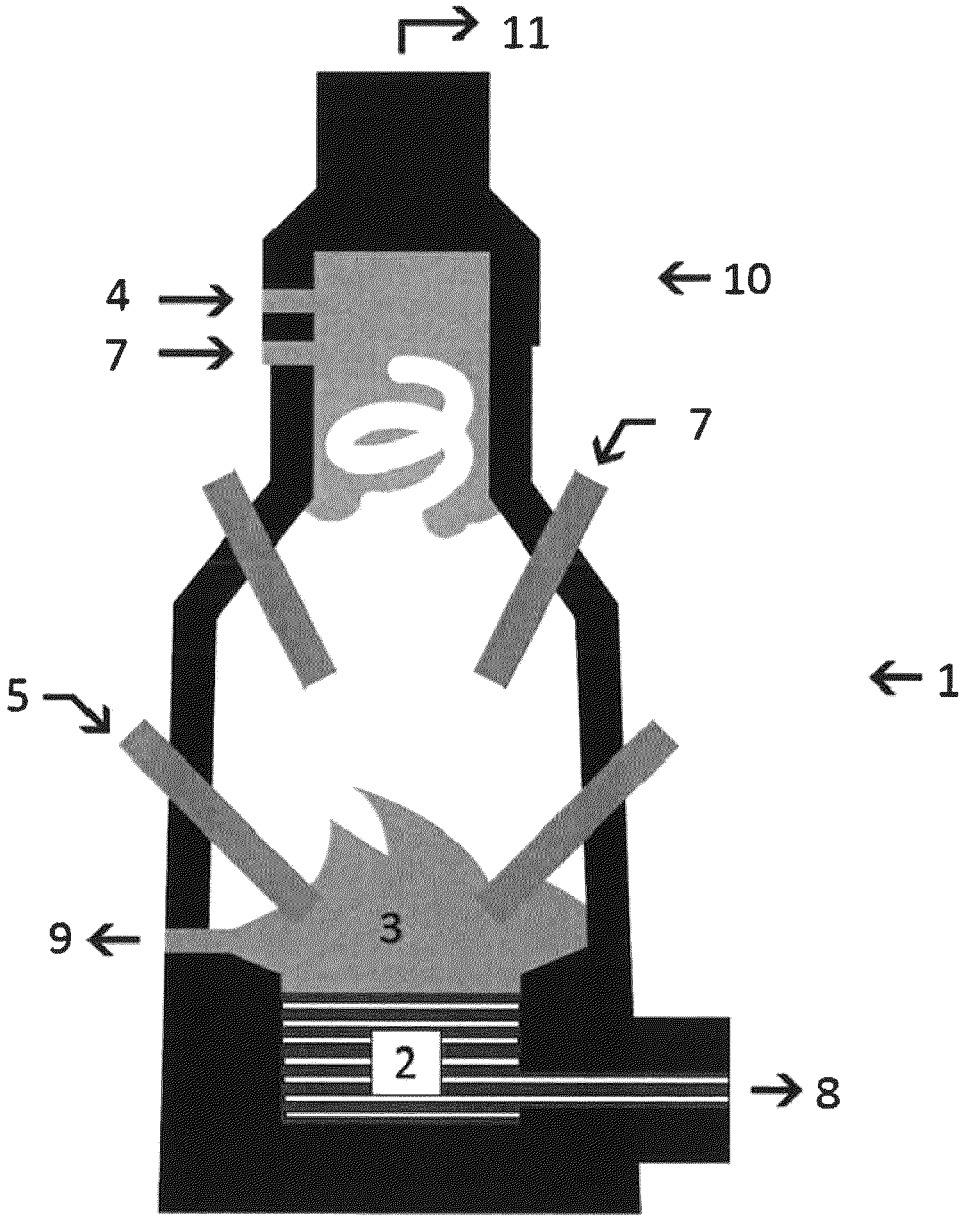
11
10
4
7
7
1
5
9
3
2
8

METHOD OF INTRODUCING A METALLIFEROUS FEED IN AN IRONMAKING PROCESS

CROSS-REFERENCE TO RELATED APPLICATIONS

This is a § 371 National Stage Application of International Application No. PCT/EP2020/075362 filed on Sep. 10, 2020, claiming the priority of European Patent Application No. 19196881.7 filed on Sep. 12, 2019.

The invention relates to a method of introducing a metalliferous feed in an ironmaking process, the method comprising the steps of, pre-drying an iron containing sludge by drying means, preferably a filter press, to an amount of 15 to 30% (w/w) moisture, mixing the pre-dried iron containing sludge with a binder material to obtain a granulate, having a particle size of less than 4 millimeter and drying the granulate to a maximum of 3% (w/w) moisture, thereby forming the metalliferous feed.

The invention also relates to a metalliferous feed for an ironmaking process and method of producing such a metalliferous feed.

Methods of converting sludge into granulates are known in the art of food and feed production. Making granulates, also called granulated material, granules or pellets is also known in the iron and steel industry. Usually this is produced in the form of sinter and pellet materials.

Iron containing sludge, for example Basic Oxygen Steelmaking sludge, or BOS-sludge is a by-product of the steelmaking process and contains iron. Typically this sludge contains moisture, varying from about 20% (w/w) to about 40% (w/w). In current practice this sludge is either recycled via the sinter plant, or exported and stored as waste material.

However, in a steelmaking site that uses an alternative ironmaking process, like the smelt reduction vessel, for example the HIsarna process by Tata Steel, a sinter plant is not needed anymore. Sinter cannot be used in the HIsarna process as it cannot be transported by means of pneumatic transport. Thus, the iron containing BOS-sludge cannot be recycled via a sinter plant, leaving waste storage as the sub-standard only option. The inventors, being involved in finding more environmentally friendly solutions, found this to be an unacceptable option and started thinking about better ways that reflect the circular economic thinking.

The object was therefore to provide a method that is able to recycle this waste material from the steelmaking process and turn this material into something that could be made to good use again in an alternative ironmaking process. Further it is an object of this invention to make the obtained material transportable via a pneumatic transport system. It is another object to be able to store the recycled material in silo's for later use. Yet another object is to reduce the amount of dust in the process (dust carry-over) such that the amount of dust in the direct environment of the steel site is reduced and both workers and nearby residents have a healthier environment that give a better quality of life.

Accordingly, a method of introducing a metalliferous feed in an ironmaking process is provided, wherein the method comprising the steps of, pre-drying an iron containing sludge by drying means to an amount of 15 to 30% (w/w) moisture, mixing the pre-dried iron containing sludge with a binder material to obtain a granulate, having a particle size of less than 4 millimeter and drying the granulate to a maximum of 3% (w/w) moisture, thereby forming the metalliferous feed, wherein the metalliferous feed is subsequently injected into a cyclone part of a metallurgical vessel.

Tests have proven that the metalliferous feed thus formed has very beneficial properties as will be explained underneath and can be injected into the cyclone part of a metallurgical vessel without any further adjustments.

As a first step the iron containing sludge is pre-dried by drying means, preferably a filter press, to an amount of 15 to 30% (w/w) moisture. It is important that the iron containing sludge is pre-dried. However, if this process is not controlled well and the iron containing sludge has a too low moisture content, it may cause the sludge to re-oxidise, like it could be the case when BOS-sludge is used. This is an unwanted process as the sludge can only be used in the ironmaking process in a reduced form. The moisture content shall be between 15-30% (w/w) and preferably be between 20 and 25% (w/w) moisture. The inventors have noted that 20% moisture (w/w) or less is possible if the sludge is mixed (second step) within 0 to 72 hours of pre-drying and preferably within 0 to 24 hours to avoid the re-oxidation process. An iron containing sludge that contains 20 to 25% moisture (w/w) is preferable since the inventors found that it optimises the particle size for use in the ironmaking process and also that it requires a lesser amount of binder material. Iron containing sludge could be used containing iron in the form of hematite ($Fe_2O_3$), magnetite ($Fe_3O_4$), wustite (FeO) or iron (Fe).

As a second step the pre-dried iron containing sludge is mixed with a binder material to obtain a granulate having a particle size of less than 4 millimeter. The binder is preferably an organic binder as this will prevent additional slag formation in the iron making process. A suitable binder material is a cellulose derivative, preferably Peridur®, a long chain polyelectrolyte based on cellulose, available through Nouryon. Good results were achieved with the addition of an amount of 0.2-0.4% (w/w) binder material. Below 0.2% (w/w) the integrity of the material is not sufficient, making it unsuitable for pneumatic transport as the material will disintegrate. Above 0.4% (w/w), the granulates become too large and too heavy for pneumatic transport. A suitable mixer is an Eirich intensive mixer, with a rotation speed of 1000 to 1500 rotations per minute. A particle size (diameter) of less than 4 millimeter was found to be a desirable particle size for pneumatic transportation purposes and a particle size of less than 3 millimeter is preferred by the inventors. If the pre-dried sludge is mixed for less than 60 seconds, preferably less than 45 seconds, then the desired particle size is achieved. It should be noted that the particle size diameter referred to in this patent application is the maximum particle size diameter of the granulate. Optionally, the granulate can be filtered to ensure a maximum particle size diameter of less than 4 millimeter.

The obtained granulate, also called micro granules or mini pellets, have very beneficial properties since they can be stored in silo's and because they are dried in the next step, re-oxidation is at least partly prevented, which means that the caloric value of the partly pre-reduced iron oxide (FeO) is maintained.

The granulate is then dried to a maximum of 3% (w/w) moisture, thereby forming the metalliferous feed. Preferred is a maximum moisture content of 2% (w/w). Drying improves the handling of the granulate considerably, especially in a pneumatic transport system. This drying step is preferably performed by a belt dryer. This has the main advantage that heat from the environment in the plant itself can be used efficiently. Under normal processing conditions this heat is lost. Dust emissions are also drastically reduced, leading to better environmental circumstances for workers and people near the steel site. Another advantage of the use of a belt dryer is that the granulate will come out stronger and does not break easily. Therefore they are easy to transport. The inventors have found that drying also increases the strength of the granulate. When the granulate goes in the dryer, they have a strength of approximately 7 Nm per granule. When leaving the dryer this has increased to more than 20 Nm per granule. A suitable apparatus to measure the strength of the granules is an Eirich TAXT Texture Analyser. A suitable method to measure the strength of the granules is ISO 4700:2015. Instead of a belt dryer a drum dryer could also be used as an alternative.

As a last step the metalliferous feed is subsequently injected into the cyclone part of a metallurgical vessel. Because of the physical properties and the chemical composition that is obtained after the steps described above, the granulate is ready to be injected in a metallurgical vessel as a metalliferous feed. The melting properties are also of vital importance. As iron containing sludge also contains a certain amount of calcium (around 10%), the melting behaviour of the granulates is optimal. But, if the chemical composition of the iron containing sludge is less than optimal, carbon (coal) could be added to improve the melting behaviour. Also fluxing materials (e.g. lime stone) could be added for the same purpose.

Using this method has a further benefit that there are no emissions of gas compounds like $SO_x$ or $NO_x$ since it is not a thermal process, so these compounds are not formed during the process. Further it is beneficial that the granules are relatively large and therefore they prevent the formation of dust in the cyclone, and therefore also in the immediate environment of the plant via the outlets. Normally the metalliferous feed is injected in a much smaller particle size, as a powder, and this powder could also clog together leaving the ironmaking process less than optimal.

Preferably the metallurgical vessel is a smelt reduction vessel. This smelt reduction vessel has a good record of reducing emissions, like $CO_2$. Therefore this is a preferable option to combat climate change and reduce the amount of carbon dioxide. We now find, that because of global warming, the nearby beach of IJmuiden reaches temperatures that used to belong to places like Praia de Ipanema. Unfortunately for some, the famous girl did not want to move.

Preferably the metalliferous feed is injected into the cyclone part of the metallurgical vessel by means of a pneumatic transport system. The normal way of introducing metalliferous feed is via pneumatic transport, since under current processing conditions a metalliferous powder is injected. By making the material granulated, it becomes also possible to pneumatically transport this and introduce it into the cyclone part of the metallurgical vessel, whilst avoiding the clogging mentioned earlier. The granules can also be stored to be used in the next batches, in silo's. This also means that there is no need to further adjust the existing equipment.

The invention will hereinafter be further elucidated with reference to the drawing of an exemplary embodiment of an apparatus operating according to the method of the invention that is not limiting as to the appended claims.

In the drawing:

FIG. 1 shows a metallurgical vessel with a cyclone part;

Whenever in the FIGURES the same reference numerals are applied, these numerals refer to the same parts.

FIG. 1 depicts the basic elements required for manufacturing iron according to the process disclosed in patent application EP-A-0 726 326, wherein a vessel 1 is applied with on top of the vessel 1 a cyclone 10. As FIG. 1 shows metalliferous feed 4 is injected in the smelt cyclone 10 at the top of the vessel 1. The metalliferous feed 4 melts and partly pre-reduces at this point, after which it drips into the vessel 1 and forms molten iron 2. Further FIG. 1 shows the bath of molten iron 2, a layer of slag 3, the introduction points for carbon containing material 5 and oxygen containing gas 7, iron outlet 8, slag outlet 9 and reaction gases outlet 11. For this invention only the introduction point of the metalliferous feed 4 is of importance.

Experiments were conducted to study the size distribution and compressive strength of several granules. Granules were produced with a 5 L Eirich mixer with a two steps mixing procedure. First, BOS-sludge and binder (Peridur 300D) were loaded together and mixed at 2000 rpm for 45 sec to ensure good homogenisation. Secondly, the materials were mixed at 500 rpm for 45 sec to reach a stable granulation. The amount of moisture in the BOS sludge and binder content was varied. The Table shows the particle size distribution indicators with respect to the parameters of the tests.

| sample | binder (wt %) | Moisture (wt %) | D10 | D50 | D90 | <0.25 mm (wt %) | drop test |
|---|---|---|---|---|---|---|---|
| 1 | 0.2 | 17 | 0.11 | 0.62 | 2.26 | 23.7 | + |
| 2 | 0.4 | 17 | 0.09 | 0.63 | 2.53 | 27.6 | + |
| 3 | 0.6 | 17 | 0.08 | 0.56 | 2.62 | 29.4 | + |
| 4 | 0.2 | 21.7 | 0.62 | 1.39 | 2.50 | 1.5 | + |
| 5 | 0.4 | 21.7 | 0.57 | 1.45 | 3.02 | 2.1 | + |
| 6 | 0.6 | 21.7 | 1.07 | 2.60 | 4.78 | 1.4 | + |

Flowability studies with a Hosokawa powder tester on granulates filtered at different particle sizes (3 mm, 1 mm, 0.4 mm) indicated that the maximum particle size should be less than 4 mm, preferably less than 3 mm in order to enable smooth pneumatic injections. Therefore, the granules should preferably have a D90 below 4 mm, more preferably below 3 mm. Granules with a larger particle size can optionally be removed by a filter. The D10 should preferably be above 0.5 to avoid carry over. The mechanical resistance of the granules was tested by a drop test to establish the optimal binder content. 500 g of each sample was selected from the matured granules (dried from original moisture in the air) and dropped 2 times from a height of 2 m, the particle size distribution of the granules before and after were similar for all granules, indicating a good mechanical resistance, even at a binder content of 0.2%. In general, a lower binder content is desired, as this will reduce the overall costs of the granules.

Sample 4 was further subjected to a plate compression test, both for green and dried granules. The average diameters of the green and dried granules are 2.4 and 2.7 mm, respectively. The average breaking forces of the green (15 to 30% moisture) and dried (at most 3% moisture) granules are 4.65 and 18.05 N, respectively. Hence, the dried granules are much stronger and better suitable for pneumatic transport and storage.

Although the invention has been discussed in the foregoing with reference to exemplary embodiments of the invention, the invention is not restricted to these particular embodiments which can be varied in many ways without departing from the invention. The discussed exemplary embodiments shall therefore not be used to construe the appended claims strictly in accordance therewith. On the contrary, the embodiments are merely intended to explain the wording of the appended claims, without intent to limit the claims to these exemplary embodiments. The scope of protection of the invention shall therefore be construed in accordance with the appended claims only, wherein a possible ambiguity in the wording of the claims shall be resolved using these exemplary embodiments.

The invention claimed is:

1. A method of introducing a metalliferous feed in an ironmaking process, the method comprising the steps of, pre-drying an iron containing sludge comprising reduced iron in a pre-dryer to an amount of 15 to 30% (w/w) moisture, mixing the pre-dried iron containing sludge comprising reduced iron with an organic binder material to form a mixture and to obtain a granulate, the granulate having a particle size of less than 4 millimeter, and drying the granulate to a maximum of 3% (w/w) moisture, thereby forming the metalliferous feed, subsequently injecting a stream of the metalliferous feed into a cyclone part of a metallurgical vessel for ironmaking by a pneumatic transport system, wherein the mixture consists of the pre-dried iron containing sludge with the 15 to 30% (w/w) moisture and the organic binder material, and wherein the granulate consists of the pre-dried iron containing sludge and the organic binder material and moisture.

2. The method according to claim 1, wherein the metalliferous feed consists of the pre-dried iron containing sludge with a maximum of 3% (w/w) moisture and the organic binder material.

3. The method according to claim 1, wherein the binder material consists of a cellulose derivative.

* * * * *